US006484716B1

(12) United States Patent
Leininger et al.

(10) Patent No.: US 6,484,716 B1
(45) **Date of Patent: *Nov. 26, 2002**

(54) HYPERBARIC OXYGEN PATIENT TREATMENT SYSTEM WITH THERAPEUTIC SURFACE

(75) Inventors: James R. Leininger; Peter A. Leininger; Ronald B. Hicks; William H. Quirk, IV, all of San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/571,423

(22) Filed: May 15, 2000

Related U.S. Application Data

(63) Continuation-in-part of application No. 09/121,746, filed on Jul. 22, 1998, now Pat. No. 6,062,215.
(60) Provisional application No. 60/053,385, filed on Jul. 22, 1997.

(51) Int. Cl.[7] ..... A61G 10/00; A61G 10/02
(52) U.S. Cl. ..... 128/202.12; 5/713; 5/909

(58) Field of Search ..... 5/629, 706, 710, 5/713, 714, 665, 676, 600, 909; 128/202.12; 600/21

(56) References Cited

U.S. PATENT DOCUMENTS

| | | | |
|---|---|---|---|
| 2,385,683 | A | 9/1945 | Burton |
| 2,700,384 | A | 1/1955 | Ivory |
| 3,729,002 | A | 4/1973 | Miller |
| 5,255,673 | A | 10/1993 | Cardwell et al. |
| 5,582,574 | A | 12/1996 | Cramer |
| 5,678,543 | A | 10/1997 | Bower |

*Primary Examiner*—Alexander Grosz

(57) ABSTRACT

A hyperbaric oxygen patient treatment system generally comprises and inflatable enclosure for encasing a patient having at least partially contained therein an inflatable mattress system. By integrating the therapeutic functions of the inflatable mattress system within the hyperbaric chamber the simultaneous provision of hyperbaric oxygen and skin treatment therapies is made possible. A control system is provided to maintain desired patient interface pressures throughout the provision of hyperbaric treatment. Features are disclosed for maximizing patient comfort while ensuring the ability to fully monitor and treat the patient during therapy. A thixotropic may also be used as part of the pressure relieving portion of the mattress system.

15 Claims, 2 Drawing Sheets

HYPERBARIC OXYGEN PATIENT TREATMENT SYSTEM WITH THERAPEUTIC SURFACE

RELATED APPLICATION

This application is a continuation in part of commonly assigned patent application Ser. No. 09/121,746 filed Jul. 22 1998 now U.S. Pat. No. 6,062,215 which claims the benefit under 35 U.S.C. §119(e) of U.S. provisional patent application Ser. No. 60/053,385 filed Jul. 22, 1997, of which, by this reference, the entire disclosure thereof is incorporated herein.

FIELD OF THE INVENTION

The present invention relates to patient treatment systems. More particularly, the invention relates to a hyperbaric oxygen patient treatment system having integrated therein a therapeutic patient support.

BACKGROUND OF THE INVENTION

Hyperbaric oxygen therapy (HBOT) dates back to as early as the 1600's when compressed air was delivered to an airtight room for the treatment of various ailments. The first contemporary HBOT programs, however, were developed in the early 1900's when the delivery to the body of increased oxygen concentrations was found to be an effective treatment for decompression sickness, commonly known as the bends. Subsequently, HBOT was approved for the treatment of carbon monoxide poisoning where it has been shown to produce recovery with little or no neurological deficit.

While HBOT is well known as the treatment of choice for decompression sickness and has a significant history in the treatment of carbon monoxide poisoning, HBOT is only recently emerging as part of other treatment regimen.

Despite the controversy surrounding the acceptance of HBOT as an element of newer protocols, HBOT has been shown to be invaluable in certain situations. One such area is in the treatment of selected non-healing wounds and compromised skin grafts and/or flaps, where the hyperoxygenation of the plasma concomitant HBOT treatment is particularly beneficial in bacteria reduction and infection control.

It has been found that HBOT has bacteriostatic and bactericidal effects on anaerobic bacteria. In particular, it is known that HBOT can inhibit the toxins produced by the synergistic bacteria found in necrotizing fasciitis—*staphylococcus aureus* and bacterioides. Although the host soft-tissue infection is considered rare, the lifesaving and limb-preserving role of HBOT in its prevention is not generally disputed. Likewise, HBOT is known to contribute to the control of aerobic infections. In particular, the increased oxygen levels resultant HBOT helps ensure the necessary oxygen required for the neutrophils to kill bacteria. It is also known that the antimicrobial effect of some antibiotics can be enhanced by HBOT. In summary, it is clear that HBOT can play a significant role in the management of wounds with acute or chronic infection.

Unfortunately, the ability to provide the patient with the beneficial HBOT does not come without difficulty. Necrotizing fasciitis usually occurs postoperatively, after trauma or after inadequate care of abscesses or cutaneous ulcers. Because patients falling into any of these categories often require therapeutic support surfaces to prevent further skin deterioration and/or related complications, it has heretofore been generally impractical to incorporate HBOT into the treatment regimen. Even if the hospital hosting the patient were one of the few having the very expensive HBOT capability, most hyperbaric chambers are not compatible with the presently available therapeutic surfaces. In the very rare case of a hospital having an entire room dedicated to HBOT known therapeutic surfaces are nonetheless rendered ineffective by the tendency for the increased pressure to compress the patient support surface. As a result, those patients with the most severe skin deterioration, and therefore most likely to benefit from HBOT, are most often excluded from HBOT due to the critical need for support upon a therapeutic skin treatment surface.

Accordingly, it is a primary object of the present invention to improve generally over the prior art by providing a platform for HBOT having integrated therein a fully compatible therapeutic patient support surface.

It is a further object of the present invention to make HBOT more readily available by providing a platform for HBOT that is inexpensive and within the capital budgets of the majority of hospitals.

It is yet another object of the present invention to still further increase the availability of HBOT by providing a platform for HBOT that is easily transportable and no or little more space consuming than presently available standard hospital beds.

It is still further an object of the present invention to facilitate the critical care of patients requiring HBOT by providing a platform for HBOT that is readily interfaced with standard treatment instrumentalities such as, for example, cardiac monitors and intravenous (IV) flows.

Still another object of the present invention is to facilitate the provision of HBOT to patients by providing an improved platform for HBOT that a mattress that reduces patient interface pressures despite the hyperbaric environment.

Finally, it is an object of the present invention to promote the general patient care by providing a platform for HBOT that is sensitive to fears and concerns of the already distressed patient such as, for example, the claustrophobia often experienced by patients subjected to HBOT.

SUMMARY OF THE INVENTION

In accordance with the foregoing objects, the present invention—a hyperbaric oxygen patient treatment system—generally comprises an inflatable enclosure for encasing a patient to receive a hyperbaric treatment and an inflatable mattress system positioned at least partially within the inflatable enclosure for supporting the patient during the hyperbaric treatment. The inflatable enclosure is adapted to withstand an internal pressure sufficient to deliver increased oxygen concentrations to the patient's body. In part, this pressure resistance is enhanced by utilizing the teachings of U.S. Pat. No. 4,728,551, issued Mar. 1, 1988 to Jay, and U.S. Pat. No. 5,362,543, issued Nov. 8, 1994 to Nickerson, and related patents (collectively, the "RIK Patents"), which disclosures are incorporated fully herein, as if fully set forth, by this reference thereto, as such teachings have evolved to become commercially available from the parent company of the assignee of both listed patents and the present invention, Kinetic Concepts, Inc., of San Antonio Tex. To prevent claustrophobic effects during periods of non-treatment without the highly undesirable requirement for transferring the patient the inflatable enclosure is adapted to be opened such that the patient is substantially uncovered.

The inflatable mattress system is adapted to compensate for the increased pressure within the inflatable enclosure during hyperbaric treatments. In at least one embodiment, where the inflatable mattress system includes an inflatable cushion, the inflatable mattress system is adapted to increase the pressure within the inflatable cushion in response to an increase in the pressure within the inflatable enclosure. Similarly, the inflatable mattress system is adapted to decrease the pressure within the inflatable cushion in response to a decrease in the pressure within the inflatable enclosure. In at least one embodiment, a control system is provided for effecting a desired interface pressure between the inflatable cushion and the patient and, thereafter, maintaining the desired interface pressure in the face of changing pressure within the inflatable enclosure. The use of RIK fluid aids in achieving this goal, as a RIK fluid containing cushion is highly resistant to, and therefore largely independent the compressive effects of the increased ambient pressures associated with HBOT.

In providing a therapeutic surface, the inflatable cushion may comprise a low air loss cell and/or there may be provided a plurality of inflatable cushions that cooperate to form a low air loss patient support surface. In the case where the patient surface is formed from a plurality of transversely oriented elongate cells, very desirable therapeutic treatments such as the well-known pulsation therapy may be provided to prevent breakdown of the skin tissues concomitant with high interface pressures. To provide the pulsation therapy, the inflatable mattress system is adapted to produce intermittent pressure differentials between adjacent transversely oriented elongate cells.

In order to simplify the design of the integral HBOT-therapeutic surface system, a source of pressurized gas in fluid communication with the inflatable cushion or cushions is located substantially within the inflatable enclosure. In the preferred embodiment of the present invention, this source of pressurized gas comprises an air or oxygen pump that may also be utilized to produce the desired hyperbaric pressure within the inflatable enclosure. Preferably, a substantially airtight electrical passage is provided from within to without the inflatable enclosure. This passage is adapted to provide operable communication for the control of the source of pressurized gas.

To facilitate other treatment of the patient while undergoing HBOT, at least one port adapted to interface a standard patient care modality is provided through the inflatable enclosure. This port is designed to maintain the internal pressure of the inflatable enclosure and may comprise an electrical connector, an intravenous tube connector, a respiratory aid device connector, a bodily waste management device connector and/or the like as may be desired.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF PREFERRED EMBODIMENT

Figure 1:
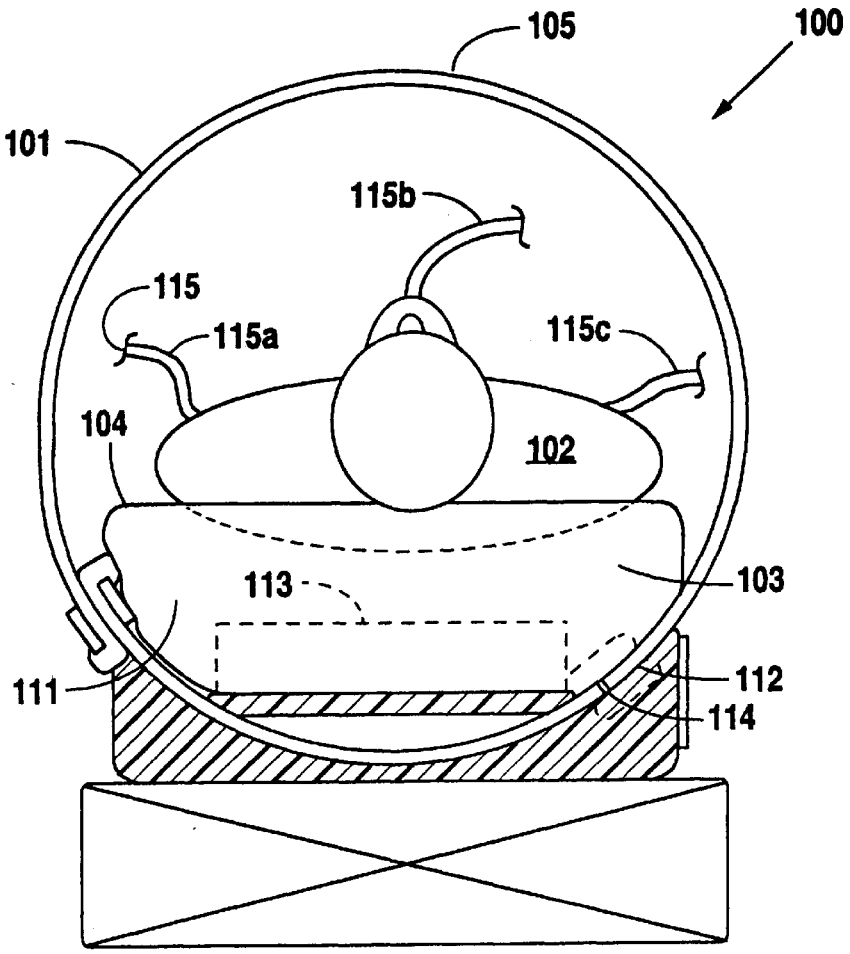
FIG. 1 shows cross-sectional view of the preferred embodiment of the present invention.
Figure 2:
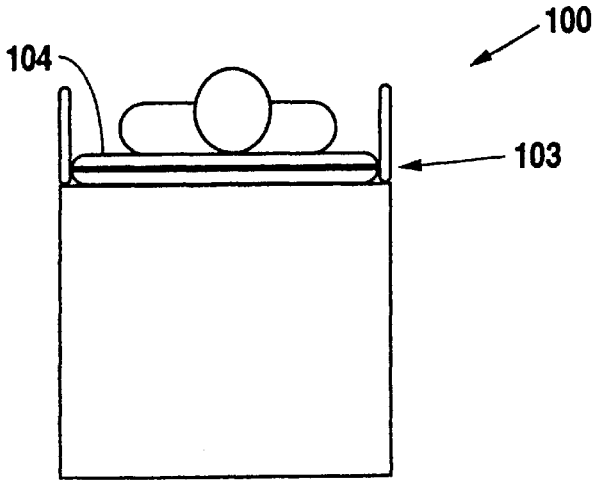
FIG. 2 shows a head end elevational view of the preferred embodiment of the present invention.
Figure 3:
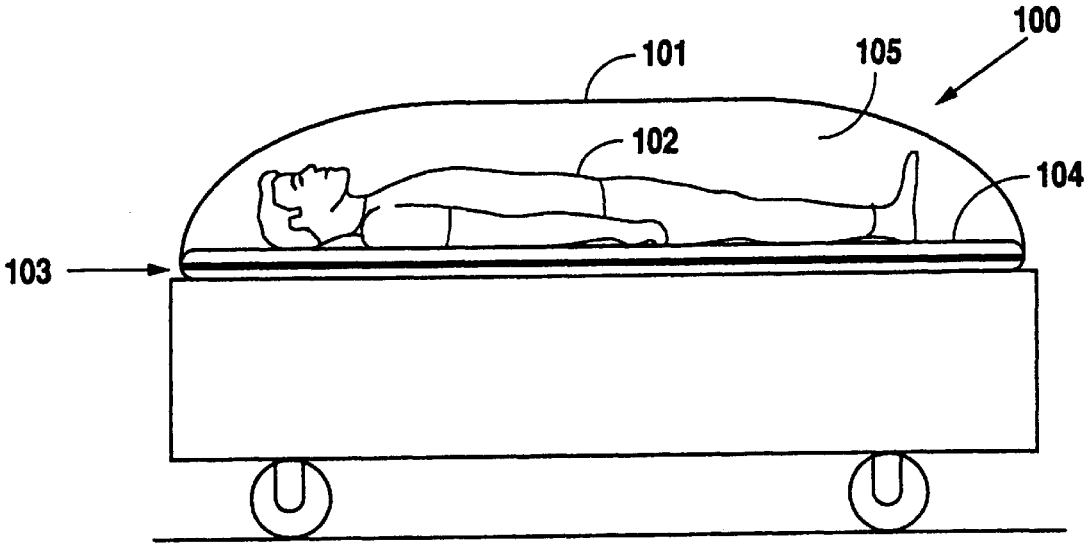
FIG. 3 shows side elevational view of the preferred embodiment of the present invention.
Figure 4:
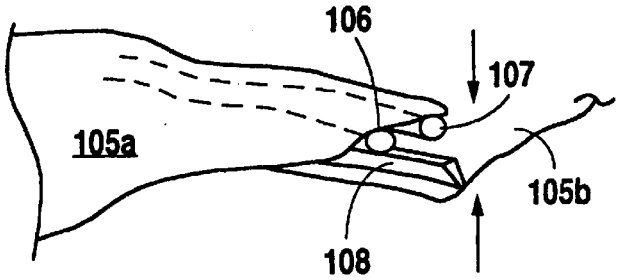
FIG. 4 shows a first embodiment of a sealing means for use with the present invention in its open configuration.

Although those of ordinary skill in the art will readily recognize many alternative embodiments, especially in light of the illustrations provided herein, this detailed description is exemplary of the preferred embodiment of the present invention 100, the scope of which is limited only by the claims appended hereto.

Referring now to the drawings, the present invention 100 generally comprises an inflatable enclosure 101 for encasing a patient 102 to receive a hyperbaric treatment and an inflatable mattress system 103 positioned at least partially within the inflatable enclosure 101 for supporting the patient 102 during the hyperbaric treatment. The inflatable enclosure 101 is adapted to withstand an internal pressure sufficient to deliver increased oxygen concentrations to the patient's body. To prevent claustrophobic effects during periods of non-treatment without the highly undesirable requirement for transferring the patient 102 the inflatable enclosure 101 is adapted to be opened such that the patient 102 is substantially uncovered.

Referring now to FIG. 1 in particular, the preferred embodiment of the present invention 100 is shown as a partial cross-section as viewed from the head end. In this preferred embodiment, the inflatable enclosure 101 is shown to have generally circular cross-section along its longitudinal axis and is also shown to at least partially enclose the mattress system 103 of the present invention. The mattress system 103 may be like any number of the well-known therapeutic patient support systems currently employed. The preferred embodiment comprises a mattress system that may be regarded as a slightly modified trademark "IMPRESSION" system, commercially available from Kinetic Concepts, Inc. of San Antonio, Tex. This mattress system is described in detail in the U.S. patent application Ser. No. 08/632,601 filed Apr. 15, 1996 that is by this reference incorporated herein. As shown in FIG. 1, the inflatable enclosure 101 is preferably positioned relative to the mattress system 103 such that the patient support surface 104 of the mattress system 103 is located at a chord line substantially below the horizontal diameter of the longitudinal cross-section. In this manner, the inflated enclosure 101 will tend to provide the maximum interior space for the patient 102 undergoing therapy.

Referring now to FIGS. 2 through 7, it is appreciated that in the preferred embodiment of the present invention 100 the inflatable enclosure 101 simply comprises a flexible flap 105 integrated with the therapeutic mattress system 103 and provided with means for simple airtight securement during use. In this manner, the patient 102 may readily be relieved of the inflatable enclosure 101 during periods of non-use. This feature not only increases patient comfort by reducing claustrophobic effects, but also increases caregiver access to the patient 102 by substantially removing the inflatable enclosure 101 from the patient during non-use.

Figure 5:
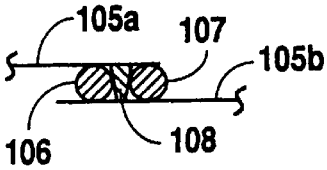
FIG. 5 shows the embodiment of FIG. 4 in its sealed configuration.
Figure 6:
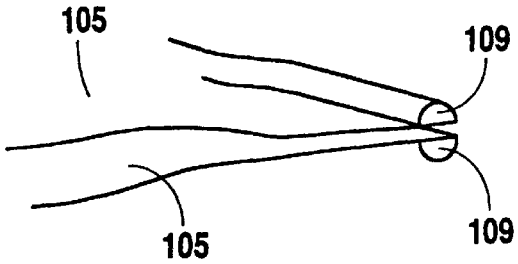
FIG. 6 shows a second embodiment of a sealing means for use with the present invention in its open configuration.
Figure 7:
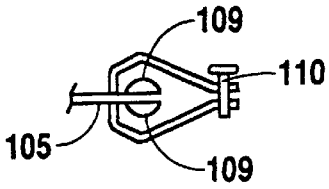
FIG. 7 shows the embodiment of FIG. 6 in its sealed configuration.

In the preferred embodiment, the flexible flap 105 comprises a Kevlar composite as described in U.S. Pat. No. 5, 255,673 issued Oct. 26, 1993 to Cardwell et al., which, by this reference, is incorporated herein. Although those of ordinary skill in the art will recognize many alternatives, FIGS. 4 through 7 show two possible embodiments for releasably sealing the inflatable enclosure 101 during use. In the first embodiment, generally shown in FIG. 4, two elongated beads 106, 107 of circular cross-section are provided adjacent the loose edges 105*a* of the flap 105. A tongue portion 108 is provided adjacent the corresponding fixed edges 105*b* of the flap 105. Much like the well-known seal for plastic bags, the inflatable enclosure 101 is sealed during periods of hyperbaric therapy. FIG. 5 details such a flap 105 in the sealed configuration. In the second embodiment, generally shown in FIG. 6, an elongated bead 109 of semicircular cross-section is provided adjacent each edge of the flap 105. A clamp 110 is then affixed to the edge to form the airtight seal.

The inflatable mattress system 103 is adapted to compensate for the increased pressure within the inflatable enclosure 101 during hyperbaric treatments. In at least one embodiment, where the inflatable mattress system 103 includes an inflatable cushion 111, the inflatable mattress system 103 is adapted to increase the pressure within the inflatable cushion 111 in response to an increase in the pressure within the inflatable enclosure 101. Similarly, the inflatable mattress system 103 is adapted to decrease the pressure within the inflatable cushion 111 in response to a decrease in the pressure within the inflatable enclosure 101.

In one embodiment, some or all of the volume of the cushion 111 is replaced with a viscous fluid having a viscosity of between about 50 and 10,000 centipoise. Preferably, this viscous fluid is RIK fluid, which is a thixotropic fluid that is commercially available from Assignee in mattresses referred to as RIK mattresses. Other viscous fluids may also be beneficially used, even water, although the RIK Fluid is presently preferred. The volume of the cushion that may be replaced by the viscous fluid may be from about 1 to about 100%. Plainly if total fluid replacement is accomplished, no gas needs to be provided to that portion of mattress system 103. Certain embodiments include mattresses with multiple cushions, some of which are gas filled, some of which are filled with the viscous fluid, others of which are filled with air and still others of which may be filled partially with air and partially with viscous fluid. Particularly, with embodiments utilizing RIK Fluid, many others adaptations may be included to enhance the mattresses operation, including the placement of an array of fluid-filled pouches atop foam columns, and the use of antishear layers, all of which are taught in the RIK Patents and many of which will be understood to those of ordinary skill in the art who are familiar with RIK mattresses. The viscous fluid may also be embedded in a foam, such as is commercially available in the cushion foams commonly referred to as "Visco-Foams."

In at least one embodiment, a control system 112 is provided for effecting a desired interface pressure between the inflatable cushion 111 and the patient 102 and, thereafter, maintaining the desired interface pressure in the face of changing pressure within the inflatable enclosure 101. Such a control system 112 is deemed to be readily within the grasp of those of ordinary skill in the art. In general, the control system 112 operates much the same as known systems with the exception that pressures must be monitored and controlled relative to the internal pressure of the inflatable enclosure 101.

In providing a therapeutic surface 104, the inflatable cushion 111 may comprises a low air loss cell and/or there may be provided a plurality of inflatable cushions that cooperate to form a low air loss patient support surface 104. In the case where the patient surface 104 is formed from a plurality of transversely oriented elongate cells, very desirable therapeutic treatments such as the well-known pulsation therapy my be provided to prevent breakdown of the skin tissues concomitant high interface pressures. To provide the pulsation therapy, the inflatable mattress system 103 is adapted to produce intermittent pressure differentials between adjacent transversely oriented elongate cells. Such a system of transversely oriented low air loss cells is described in detail in the U.S. Patent application Ser. No. 08/672,442 filed Jul. 14, 1998, which, by this reference, is incorporated herein.

In order to simplify the design of the integral HBOT-therapeutic surface system 100, a source 113 of pressurized gas in fluid communication with the inflatable cushion 111 or cushions is located substantially within the inflatable enclosure 101. In the preferred embodiment of the present invention, this source 113 of pressurized gas comprises an air or oxygen pump that may also be utilized to produce the desired hyperbaric pressure within the inflatable enclosure 101. Preferably, a substantially airtight electrical passage 114 is provided from within to without the inflatable enclosure 101. This passage 114 is adapted to provide operable communication for the control of the source 113 of pressurized gas. This general type of integration is described in detail in U.S. patent application Ser. No. 08/632,601 filed Apr. 15, 1996, which has been by reference incorporated herein.

To facilitate other treatment of the patient while undergoing HBOT, at least one port 115 adapted to interface a standard patient care modality is provided through the inflatable enclosure 101. This port 115 is designed to maintain the internal pressure of the inflatable enclosure 101 and, as shown in FIG. 1, may comprise an electrical connector, an intravenous tube connector 115*a*, a respiratory aid device connector 115*b*, a bodily waste management device connector 115*c* and/or the like as may be desired.

While the foregoing description is exemplary of the preferred embodiments of the present invention 100, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A hyperbaric oxygen patient treatment system, said treatment system comprising:

an inflatable enclosure for encasing a patient to receive a hyperbaric treatment, said inflatable enclosure being adapted to withstand an internal pressure sufficient to deliver increased oxygen concentrations to the patient's body;

and a mattress system for supporting the patient during the hyperbaric treatment, said mattress system including an inflatable cushion positioned at least partially within said inflatable enclosure, said cushion being at least partially inflated with a viscous fluid.

2. The hyperbaric oxygen patient treatment system as recited in claim 1 wherein said viscous fluid is a thixotropic fluid.

3. The hyperbaric oxygen patient treatment system as recited in claim 2, wherein said inflatable enclosure is adapted to be opened such that the patient is substantially uncovered.

4. The hyperbaric oxygen patient treatment system as recited in claim 1, wherein said cushion has a volume of which from about 1% to about 100% of said volume is occupied by the viscous fluid, and wherein the viscous fluid has a viscosity of from about 50 to about 10000 centipoise.

5. The hyperbaric oxygen patient treatment system as recited in claim 1, wherein:

said inflatable enclosure forms a substantially circular cross section in the longitudinal direction when said inflatable enclosure is pressurized; and said inflatable mattress system is located within said inflatable enclosure at a lower chord substantially below the horizontal diameter of said inflatable enclosure's longitudinal cross section.

6. A hyperbaric oxygen patient treatment system, said treatment system comprising:

an inflatable enclosure for encasing a patient to receive a hyperbaric treatment, said inflatable enclosure being adapted to withstand an internal pressure sufficient to deliver increased oxygen concentrations to the patient's body;

and a mattress system for supporting the patient during the hyperbaric treatment, said mattress system including a plurality of inflatable cushions positioned at least partially within said inflatable enclosure, said cushions being at least partially inflated with a viscous fluid.

7. The hyperbaric oxygen patient treatment system as recited in claim 6, wherein each said inflatable cushion comprises a transversely oriented elongate cell.

8. The hyperbaric oxygen patient treatment system as recited in claim 6, said treatment system further comprising:

a control system for effecting a desired interface pressure between said mattress system comprising an inflatable cushion and the patient and maintaining said desired interface pressure in the face of changing internal pressure within said inflatable enclosure.

9. The hyperbaric oxygen patient treatment system as recited in claim 6, wherein said inflatable mattress system is adapted to produce intermittent pressure differentials between adjacent cushions.

10. The hyperbaric oxygen patient treatment system as recited in claim 6, wherein said inflatable enclosure comprises at least one port, said port being adapted to interface a standard patient care modality through said inflatable enclosure while substantially maintaining the internal pressure of said inflatable enclosure.

11. The hyperbaric oxygen patient treatment system as recited in claim 6, wherein said inflatable enclosure comprises at least one port adapted to interface a standard patient care modality through said inflatable enclosure while substantially maintaining the internal pressure of said inflatable enclosure.

12. The hyperbaric oxygen patient treatment system as recited in claim 11, wherein at least one said port comprises an intravenous tube connector.

13. The hyperbaric oxygen patient treatment system as recited in claim 11, wherein at least one said port comprises a respiratory aid device connector.

14. The hyperbaric oxygen patient treatment system as recited in claim 11, wherein at least one said port comprises a bodily waste management device connector.

15. The hyperbaric oxygen patient treatment system as recited in claim 11, wherein at least one said port comprises an electrical connector.

* * * * *